US010550662B2

(12) United States Patent
Lou et al.

(10) Patent No.: US 10,550,662 B2
(45) Date of Patent: Feb. 4, 2020

(54) INHIBITING LONGITUDINAL PROPAGATION OF CRACKS IN WELLBORE CEMENT

(71) Applicant: SCHLUMBERGER TECHNOLOGY CORPORATION, Sugar Land, TX (US)

(72) Inventors: Yucun Lou, Belmont, MA (US); Meng Qu, Waltham, MA (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 346 days.

(21) Appl. No.: 14/857,122

(22) Filed: Sep. 17, 2015

(65) Prior Publication Data

US 2017/0081942 A1 Mar. 23, 2017

(51) Int. Cl.

| | |
|---|---|
| ***E21B 33/14*** | (2006.01) |
| ***E21B 47/00*** | (2012.01) |
| ***E21B 49/00*** | (2006.01) |

(52) U.S. Cl.

CPC ..... *E21B 33/14* (2013.01); *E21B 47/0005* (2013.01); *E21B 47/0006* (2013.01); *E21B 49/00* (2013.01)

(58) Field of Classification Search

CPC .. E21B 33/14; E21B 47/0005; E21B 47/0006; E21B 49/00; C09K 8/42

See application file for complete search history.

(56) References Cited

U.S. PATENT DOCUMENTS 4,607,698 A * 8/1986 Wood ..... E21B 33/14 138/145
5,964,292 A * 10/1999 Hewitt ..... B32B 5/16 166/292
6,071,613 A * 6/2000 Rieder ..... C04B 20/0052 106/638

(Continued)

FOREIGN PATENT DOCUMENTS

WO WO2014154582 A1 10/2014

OTHER PUBLICATIONS

Biezen, E. et al., "Experimental and Numerical Study of Drilling Fluid Removal from a Horizontal Wellbore" SPE 62887-MS, Society of Petroleum Engineers, 2000, pp. 1-14.

(Continued)

*Primary Examiner* — Nicole Coy
*Assistant Examiner* — Yanick A Akaragwe

(57) ABSTRACT

Procedures include designing parameters for cementation jobs based upon the wellbore geometries and loading conditions. The cementation parameters such as Young's modulus are selected such that longitudinal crack propagation is inhibited. Procedures also include determining critical loading conditions for an already-cemented casing annulus based upon the specified cement properties and wellbore conditions. The critical loading conditions are determined such that longitudinal crack propagation in the cement is inhibited. Techniques are used to improve the friction coefficients between the casing and cement to inhibit longitudinal crack propagation. The treatments can include forming surface patterns that enhance friction and/or making the casing surface oleophopic and/or hydrophilic.

12 Claims, 8 Drawing Sheets

(56) References Cited

U.S. PATENT DOCUMENTS

| | | | | |
|---|---|---|---|---|
| 7,337,841 | B2 * | 3/2008 | Ravi | E21B 17/00 166/242.1 |
| 7,712,530 | B1 * | 5/2010 | Edgley | C04B 28/02 106/800 |
| 2014/0202697 | A1 * | 7/2014 | James | E21B 17/00 166/285 |
| 2015/0232736 | A1 * | 8/2015 | Khammar | C09K 8/46 166/293 |
| 2016/0258256 | A1 * | 9/2016 | Nguyen | E21B 43/088 |

OTHER PUBLICATIONS

Bosma, M. et al., "Design Approach to Sealant Selection for the Life of the Well", SPE 56536-MS, Society of Petroleum Engineers, 1999, pp. 1-14.

Boukhelifa, L. et al., "Evaluation of Cement Systems for Oil and Gas Well Zonal Isolation in a Full-Scale Annular Geometry", SPE 87195-PA, SPE Drilling & Completion, 2005, pp. 44-53.

Carter, L. G. et al., "Stress Capabilities Improved by Resilient Cement", API 68-029, American Petroleum Institute, 1968, pp. 29-37.

Debruijn, G. G. et al., "Flexible Cement Improves Wellbore Integrity in Sagd Wells", SPE 119960-MS, Society of Petroleum Engineers, 2009, pp. 1-18.

Garnier, A. et al., "An Innovative Methodology for Designing Cement- Sheath Integrity Exposed to Steam Stimulation", SPE 117709, SPE Drilling and Completion, 2010, pp. 58-69.

Goodwin, K. J. et al., "Cement Sheath Stress Failure", SPE 20453-PA, Society of Petroleum Engineers, 1992, pp. 291-296.

Ho, S. et al., "Microcracks Tunneling in Brittle Matrix Composites Driven by Thermal Expansion Mismatch", Acta Metallurgica et Materialia, 1992, 40(7), pp. 1685-1690.

Qu, M. et al., "On the Role of Bubbles in Metallic Splat Nanopores and Adhesion", Journal of Thermal Spray Technology, 2008, 17(4), pp. 486-494.

Stiles, D. et al., "Implementation of Advanced Cementing Techniques to Improve Long Term Zonal Isolation in Steam Assisted Gravity Drainage Wells" SPE 78950-MS, Society of Petroleum Engineers, 2002, pp. 1-8.

Thiercelin, M. J. et al., "Cement Design Based on Cement Mechanical Response", SPE 38598-MS, Society of Petroleum Engineers, 1997, pp. 337-348.

Ulm, F.-J. et al., "The Scratch Test for Strength and Fracture Toughness Determination of Oil Well Cements Cured at High Temperature and Pressure", Cement and Concrete Research, 2011, 41(9), pp. 942-946.

International Search Report and Written Opinion of International Patent Application No. PCT/US2016/048504 dated Dec. 15, 2016, 14 pages.

* cited by examiner

INHIBITING LONGITUDINAL PROPAGATION OF CRACKS IN WELLBORE CEMENT

FIELD

The subject disclosure generally relates to the field of zonal isolation of wellbores using cement. More particularly, the subject disclosure relates to techniques for inhibiting longitudinal propagation of cracks in wellbore cement.

BACKGROUND

Cement has been widely used in the oilfield industry where it is placed in the annular gap between casings, and between the casing and the formation wall. Cement is used because of its low cost, low permeability, and its ability to set under water. Cement is used to prevent casing corrosion, provide mechanical strength and, to provide zonal isolation where fluid communication is prevented between different zones throughout the lifetime of the well. Even when the cement sheath is initially properly set, it can be damaged by the stresses induced by downhole temperature and pressure changes, which can be caused by, for example, drilling of wellbore, perforation of casing and hydraulic fracture stimulation of reservoir. Once the cement sheath is damaged and loses its integrity, the consequences can include loss of hydrocarbon production, environmental pollution, and even catastrophic disasters. Furthermore, preventing cement failure is becoming even more important due to the increase in the number of wells operated in extreme conditions, as well as increasingly rigorous environmental regulation.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

According to some embodiments a method is described for cementing an annular volume within a wellbore. The volume is partially defined by an outer surface of a casing. The method includes determining one or more properties for performing the cementing which results in a cement within the annular volume that is resistant to crack propagation in directions parallel to a main longitudinal axis of the wellbore. The determination is based in part on an expected amount of friction between the outer surface of the casing and the cement. The method also includes cementing the annular volume according to the determined properties.

According to some embodiments the determined properties include Young's modulus of the cement. The annular volume can be further defined by an inner surface of a rock formation. The determining can also be based on a calculation of one or more values for energy release rate of the cement. The release rate values can be calculated assuming (a) no sliding between the cement and the casing, and (b) no friction between the cement and the casing.

According to some embodiments, a method of inhibiting longitudinal propagation of cracks in cement in an annular volume within a wellbore is described. The method includes determining one or more critical pressure load values for use as an upper fluid pressure limit within the casing for avoiding longitudinal propagation of cracks in the cement, based in part on an expected amount of friction between the outer surface of the casing and the cement. The method also includes carrying out a pressure-increasing procedure in the wellbore while ensuring fluid pressure within the casing remains below the one or more critical pressure load values.

According to some embodiments, the determining of the critical pressure load values includes comparing cement toughness with energy release rate values for the cement assuming no sliding between the cement and casing and assuming no friction between the cement and casing. The critical pressure load value determination can also be based on other conditions such as cement yielding conditions obtained from strength analysis.

According to some embodiments, a method is described for inhibiting longitudinal propagation of cracks in cement in an annular volume within a wellbore. The method includes enhancing friction between the outer surface of the casing and the cement by treating the outer surface of the casing thereby inhibiting propagation of cracks in the cement extending in directions parallel to a main longitudinal axis of the wellbore. According to some embodiments, the treating occurs during manufacture of the casing. The treatment can include alterations of the outer surface of the casing such as forming friction enhancing structured patterns thereon. The treatment can also include altering the surface morphology so as to be oleophobic and/or hydrophilic.

According to some embodiments, a wellbore traversing a subterranean rock formation includes a casing extending longitudinally along a main axis of the wellbore; and a crack-resistant cement sheath formed in the annulus. The friction between the outer surface of the casing and the cement sheath is enhanced by a treatment on the outer surface thereby inhibiting propagation of cracks in the cement sheath extending in directions parallel to the main longitudinal axis of the wellbore.

Further features and advantages of the subject disclosure will become more readily apparent from the following detailed description when taken in conjunction with the accompanying drawings.

BRIEF DESCRIPTION OF THE DRAWINGS

The subject disclosure is further described in the detailed description which follows, in reference to the noted plurality of drawings by way of non-limiting examples of the subject disclosure, in which like reference numerals represent similar parts throughout the several views of the drawings, and wherein.

DETAILED DESCRIPTION

Figure 1:
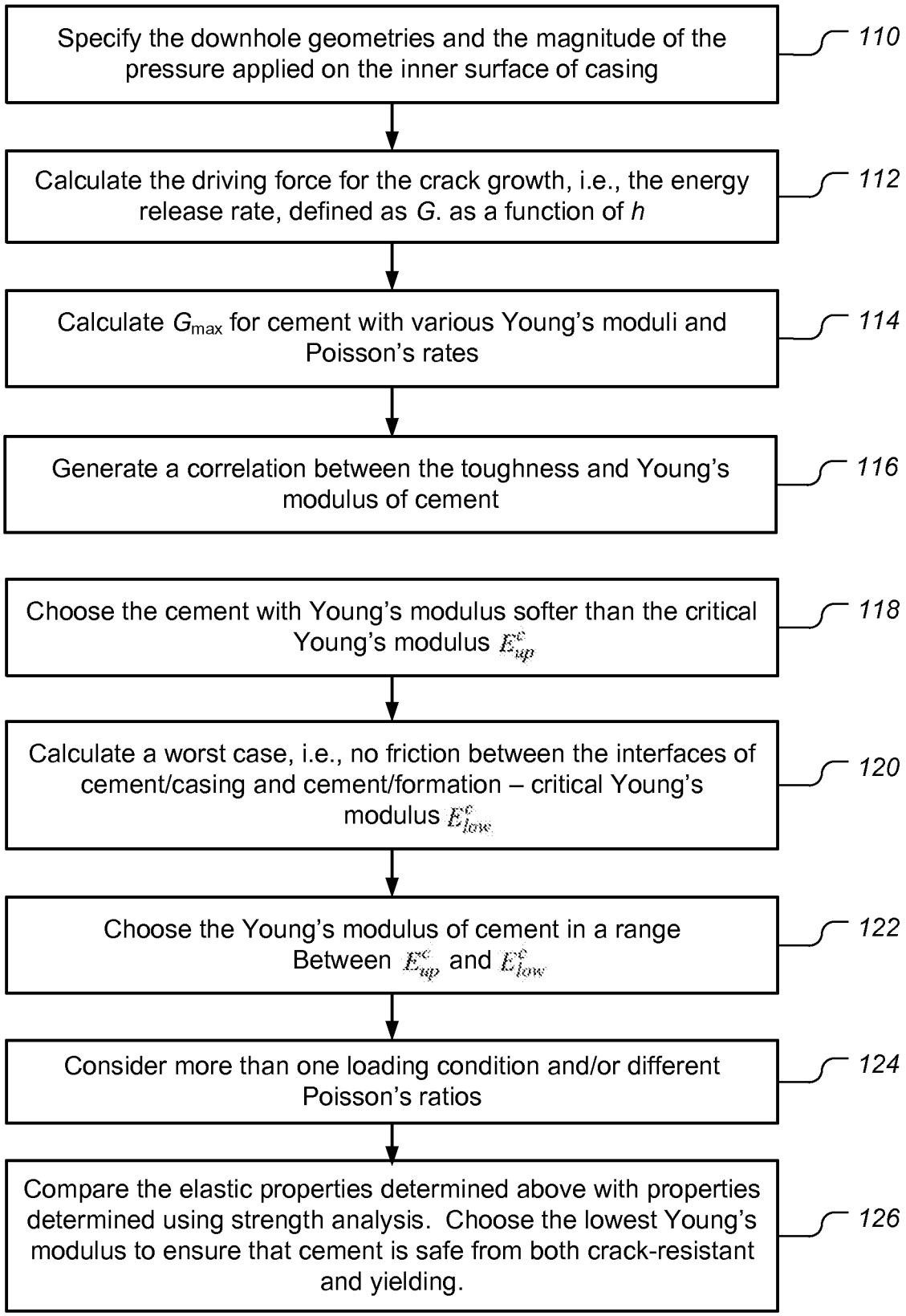
FIG. 1 is a flow chart illustrating a procedure to determine the cement properties based upon the wellbore geometries and loading conditions, according to some embodiments.

The particulars shown herein are by way of example and for purposes of illustrative discussion of the examples of the subject disclosure only, and are presented in the cause of providing what is believed to be the most useful and readily understood description of the principles and conceptual aspects of the subject disclosure. In this regard, no attempt is made to show structural details in more detail than is necessary, the description taken with the drawings making apparent to those skilled in the art how the several forms of the subject disclosure may be embodied in practice. Furthermore, like reference numbers and designations in the various drawings indicate like elements.

The current approach to determine the cement failure is mainly using strength analysis. See, e.g. Goodwin, K.J., & Crook, R.J. (1992, Dec. 1). Cement Sheath Stress Failure. Society of Petroleum Engineers. doi:10.2118/20453-PA; Thiercelin, M.J., Dargaud, B., Baret, J. F., & Rodriguez, W.J. (1997, Jan. 1), Cement Design Based on Cement Mechanical Response. Society of Petroleum Engineers. doi:10.2118/38598-MS (hereafter "Thiercelin, Dargaud et al. 1997"); Stiles, D. and D. Hollies, Implementation of Advanced Cementing Techniques to Improve Long Term Zonal Isolation in Steam Assisted Gravity Drainage Wells. Society of Petroleum Engineers 78950 (2002); and DeBruijn, G.G., A. Gamier, R. Brignoli, D. C. Bexte and D. Reinheimer, Flexible Cement Improves Wellbore Integrity in SAGD Wells. SPE/IADC 119960 (2009). For example, the stress fields of cement are calculated using linear elastic theory and the failure is determined by Coulomb-Mohr criteria (see, Thiercelin, Dargaud et al. 1997). When the cement deformation is assumed to be axisymmetric, friction force in the cement/casing and cement/formation interfaces has no effects on the strength analysis. These analyses are used to determine the critical external load (e.g., pressure for hydraulic fracture) for a given cement system or to design cement with specified mechanical properties for given wellbore conditions.

However, in practice it can be assumed that at least some cracks are generated inside the cement sheath. These can be, for example, due to shrinkage during cement hydration or damage caused by perforation and hydraulic fracturing. These pre-existing cracks can propagate longitudinally (i.e. in directions parallel to the axis of the wellbore) forming a crack channel, which leads to the loss of zonal isolation, even before the stresses in cement reaches its yield strength. For example, Carter et al. observed that when the cement sheath was unconfined, a thin crack channel was formed longitudinally throughout the length of cement when the stresses inside cement is lower than yield strength. See, Carter, L.G., Slagle, K.A., & Smith, D.K. (1968, Jan. 1) Stress Capabilities Improved by Resilient Cement, American Petroleum Institute. It has been observed that a thin crack tunnel can be formed that connects the top and bottom of cement sheath under the thermal loading. It has also be observed that permeability of cement increased two orders of magnitude due to the crack generated by the loading cycles. See, e.g. Gamier, A., Saint-Marc, J., Bois, A.-P., & Kermanacaposh, Y. An Innovative Methodology for Designing Cement-Sheath Integrity Exposed to Steam Stimulation. Society of Petroleum Engineers, doi:10.2118/117709-PA (2010, Mar. 1) (hereinafter "Gamier, Saint-Marc et al. 2010"); and Boukhelifa, L., Moroni, N., James, S., Le Roy-Delage, S., Thiercelin, M. J., & Lemaire, G., Evaluation of Cement Systems for Oil and Gas Well Zonal Isolation in a Full-Scale Annular Geometry, Society of Petroleum Engineers, doi:10.2118/87195-PA (2005, Mar. 1).

Failure of cement sheath due to crack growth has been studied recently. See, Gamier, Saint-Marc et al. 2010; and Ulm, FJ., Abuhaikal, M., Petersen, T., Pellenq R. Poro-chemo-fracture-mechanics bottom-up: Application to risk of fracture design of oil and gas cement sheath at early ages, Computational Modelling of Concrete Structures 1, pp. 64 (2014). These works were focused on the crack growth along the cross-section of cement sheath (i.e. in the radial direction). However, radially propogating cracks tend to cause local damage. It has been found that the phenomenon of longitudinal propagation of cracks has not been adequately studied. The failure criteria developed in previous analysis of radial crack propagation cannot be used for longitudinal crack propagation for wellbore cement that can extend thousands of feet in length. In addition, the friction forces in the cement/casing interface and cement/formation interface, which can significantly affect the growth of channeling/longitudinal crack, has not been systematically studied. Although adhesion between cement and casing is discussed in U.S. Patent Publication No. US20140202697A1, which is incorporated herein by reference, methods to improve the friction between cement and casing were not described.

According to some embodiments, a design procedure is described that can inhibit or prevent longitudinal propagation of cracks inside the cement sheath. Using this procedure, one can design cement with specified mechanical properties and/or determine the critical load that can be applied to the cement based upon downhole conditions. In some embodiments, the longitudinal crack-resistance is improved by increasing friction in the cement/casing interface. According to some embodiments, several methods are described to improve the friction coefficient in the cement/casing interface. As used herein, the term "tunneling crack" in wellbore cement refers to a crack in the cement that extends longitudinally, or in a direction or directions parallel to the main longitudinal axis of the wellbore. As used herein "extends longitudinally" means extending substantially in the longitudinal direction when compared to the diameter of the wellbore. For example, a tunneling crack ordinarily extends at least ten times the diameter of the wellbore and often extends much more than this amount.

According to some embodiments, design procedures are described for inhibiting or preventing the longitudinal propagation of tunneling cracks inside cement sheath of a wellbore. The procedures can be used to specify the mechanical properties of cement based upon downhole geometries and loading conditions. They can also be used to determine the maximum load that can be applied on the inner surface of casing, e.g., the maximum pressure for hydraulic fracture job, based upon the properties of cement. One advantage is that the inputs used in these methods are similar to those used for strength analysis. Detailed knowledge of pre-existing cracks, e.g., the size and location of cracks, is not required.

Figure 2:
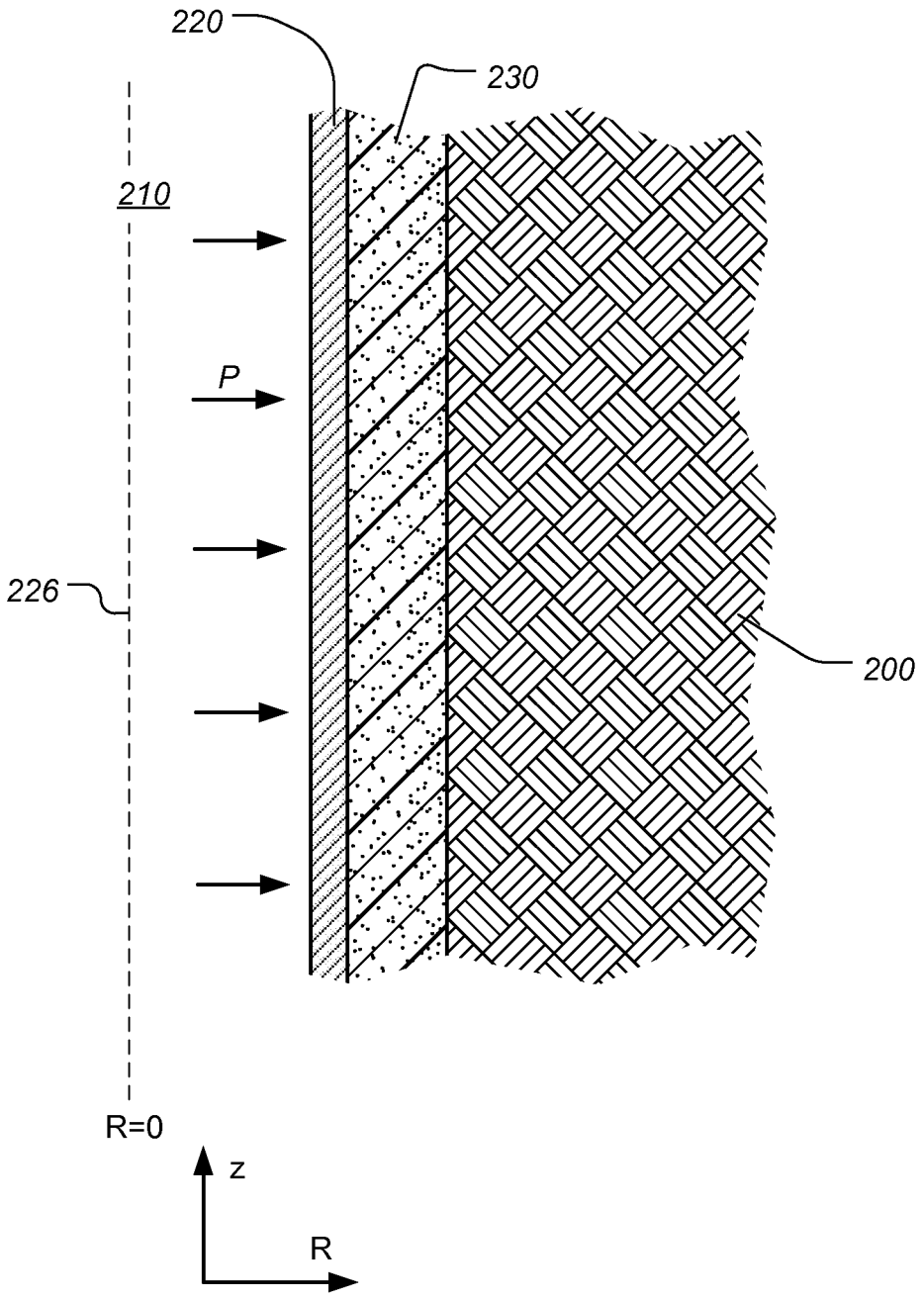
FIG. 2 is a partial cross section of a simple wellbore geometry, according to some embodiments.
Figure 3A:
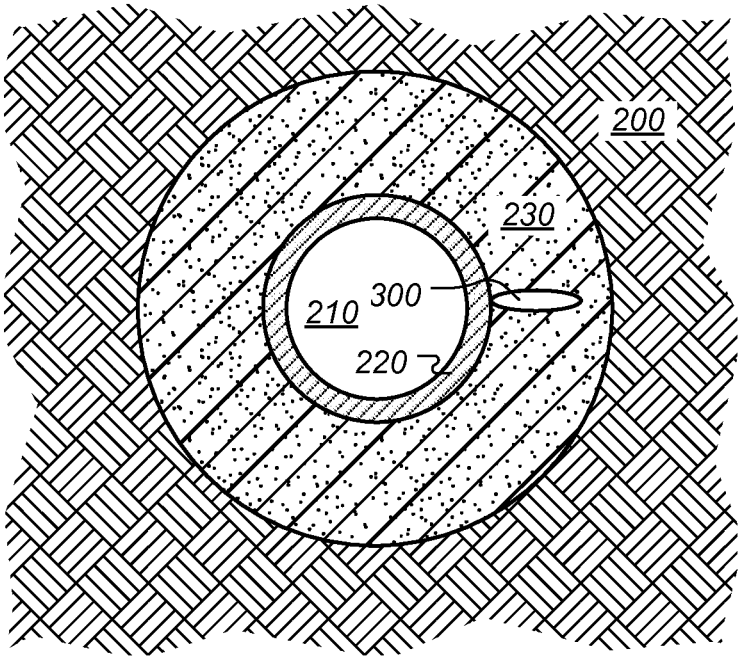
FIGS. 3A and 3B are lateral and longitudinal cross sections, respectively, of a wellbore and wellbore cement, according to some embodiments.
Figure 3B:
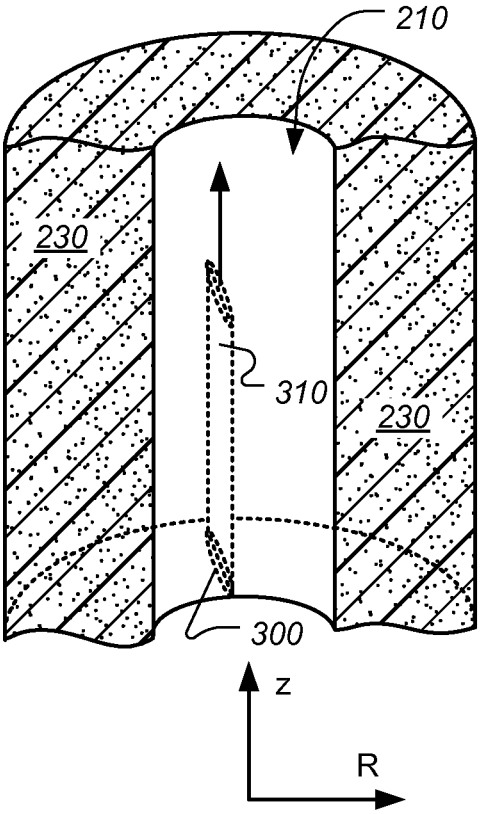

FIG. 1 is a flow chart illustrating a procedure to determine the cement properties based upon the wellbore geometries and loading conditions, according to some embodiments. In block 110, the downhole geometries and the magnitude of the pressure applied on the inner surface of a casing are specified. FIG. 2 is a partial cross section of a simple wellbore geometry, according to some embodiments. The wellbore 210 is formed within rock formation 200. The wellbore is cased using a casing 220. The annular volume between the rock formation 200 and the casing 220 is filled with wellbore cement 230. The wellbore 210 has central longitudinal axis 226. FIGS. 3A and 3B are lateral and longitudinal cross sections, respectively, of a wellbore and wellbore cement, according to some embodiments. In FIG. 3A, the wellbore 210 is shown formed within rock formation 200. Also visible is casing 220 and cement 230 in the annular volume between the rock formation 200 and the casing 220. A pre-existing radially extending crack 300 is located within cement 230. In FIG. 3B, the casing and rock formation are not shown for clarity. The original crack 300 is visible within cement 230. In this case, the original crack 300 has propagated to form a tunneling crack 310, which in this case is propagating upwards in the Z direction.

Figure 4:
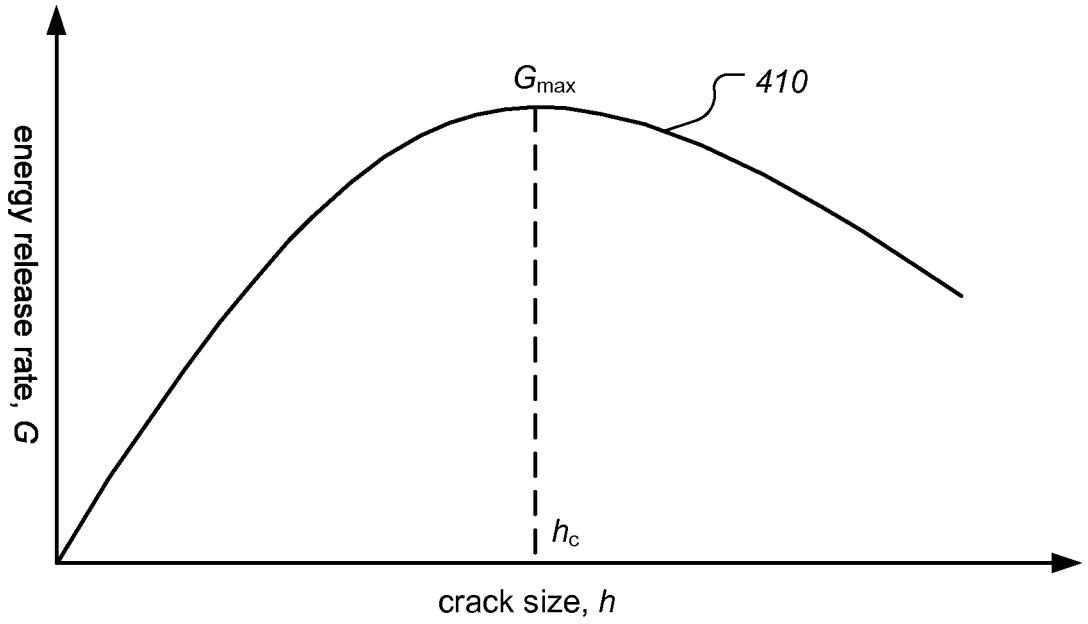
FIG. 4 is a schematic graph plotting energy release rate as a function of crack size, according to some embodiments.

Referring again to FIG. 1, in block 112, a pre-existing tunneling crack with opening size h (i.e. the crack length in the radial direction is h) is inside cement sheath, as illustrated by crack 300 in FIG. 3A. A "no-sliding" condition is assumed for the cement/casing and cement/formation interfaces. The driving force for the crack growth, i.e., the energy release rate, defined as G is defined as a function of h. Further details of the definition of G can be found infra. FIG. 4 is a schematic graph plotting energy release rate as a function of crack size, according to some embodiments. Curve 410 shows energy release rate changing with crack size h. There exist a critical crack size, $h_c$, that has the largest driving force to grow, i.e., $G_{max}$. Because the cement sheath is thousands of feet long, we anticipate that at least one crack such as crack 300 will exist in practice. Therefore, $G_{max}$ is used to compare with cement toughness and determine the failure of cement.

Figure 5A:
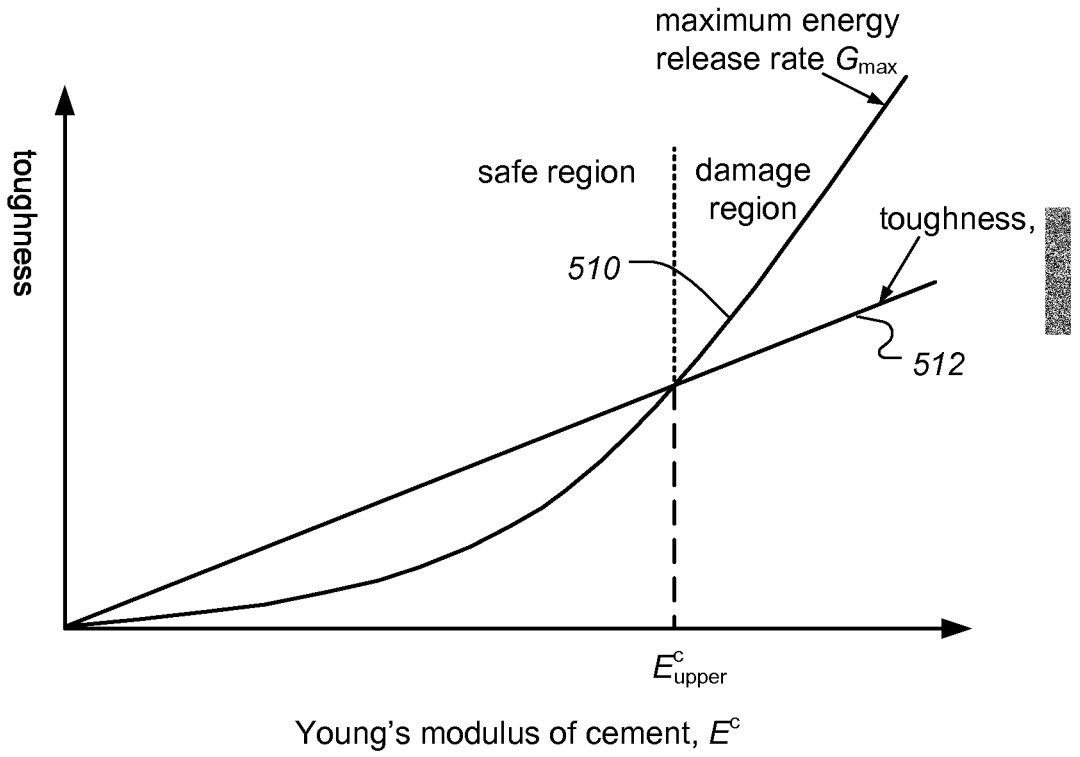
FIGS. 5A and 5B are schematic graphs comparing maximum energy release rate and toughness against Young's modulus for cement, according to some embodiments.
Figure 5B:
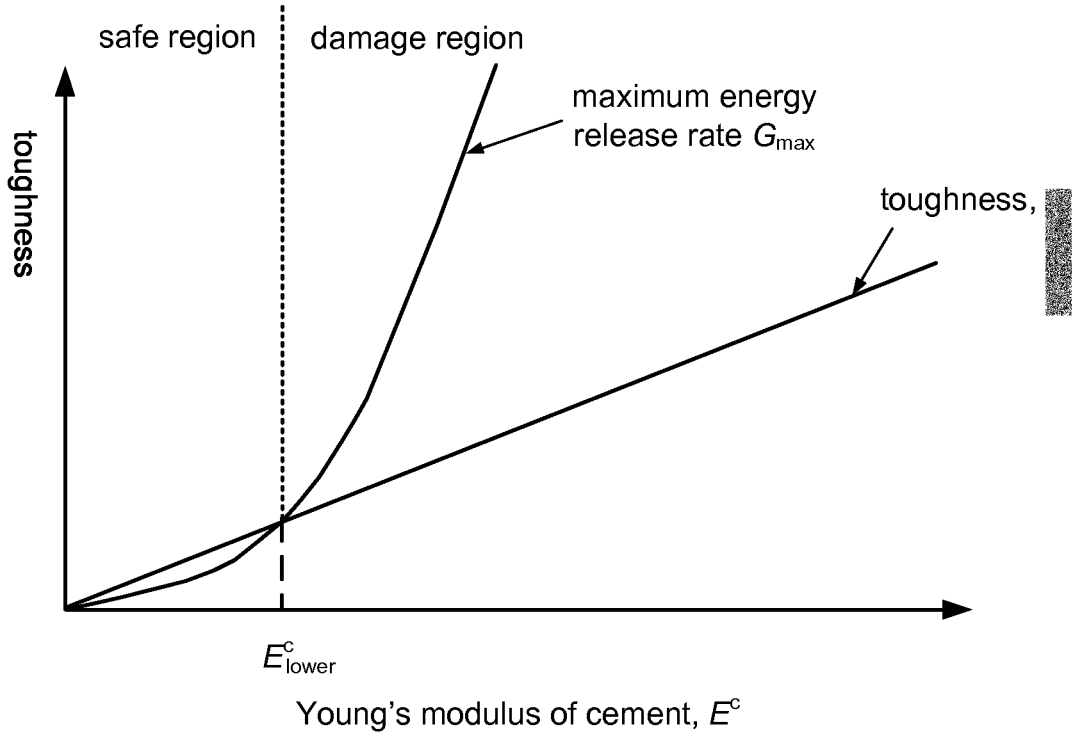

In block 114 of FIG. 1, we calculate $G_{max}$ for cement with various Young's moduli and Poisson's rates. In general, energy release rates increases with increasing the stiffness of cement. First, we take the Poisson's ratio as a constant and calculate the energy release rate as a function of the Young's modulus of cement. FIGS. 5A and 5B are schematic graphs comparing maximum energy release rate and toughness against Young's modulus for cement, according to some embodiments. In FIG. 5A, curve 510 shows $G_{max}$ changing with the Young's modulus of cement.

In block 116 of FIG. 1, depending on the types of cement we intend to choose, e.g., conventional cement or flexible cement (cement/rubber composite), we generate a correlation between the toughness and Young's modulus of cement. That can be done through a series of experiments. See, e.g., Ulm, F.-J. and S. James, The scratch test for strength and fracture toughness determination of oil well cements cured at high temperature and pressure, Cement and Concrete Research 41(9): 942-946 (2011), hereinafter "James and Ulm, 2011". A schematic plot for the toughness changing with the Young's modulus of cement is plotted as the curve 512 in FIG. 5A.

In order to prevent longitudinal propagation of a tunneling crack growing inside cement sheath, we can require that $G_{max}<\Gamma$. Therefore, in block 118 of FIG. 1, we should choose the cement with Young's modulus softer than the critical Young's modulus $E_{up}^{c}$, i.e., the region to the left of $E_{up}^{c}$ in FIG. 5A, while the region to the right of $E_{up}^{c}$ FIG. 5A means that the cement is under the risk of damaging by tunneling cracks.

In block 120 of FIG. 1, we also calculate a worst case, i.e., with no friction at the cement/casing interface and at the cement/formation interface. Using the similar approaches discussed with respect to blocks 112, 114, 116 and 118, we estimate the critical Young's modulus $E_{low}^{c}$, as shown in FIG. 5B.

In block 122 of FIG. 1, we can choose the Young's modulus of cement in a range between $E_{low}^{c}$ and $E_{up}^{c}$. For example, if we have done a good job in removing contaminants from the outer surface of the casing, we can choose the modulus close to $E_{up}^{c}$. Otherwise, we need to choose the modulus close to $E_{low}^{c}$ for purposes of ensuring safety.

In block 124, if we need to consider more than one loading condition or different Poisson's ratios, we can do the similar analysis using blocks 110, 112, 114, 116, 118, 120 and 122. In block 126, we can compare the elastic properties determined from blocks 110, 112, 114, 116, 118, 120, 122 and 124 with the properties determined using a conventional strength analysis. According to some embodiments, the lowest Young's modulus is chosen to ensure that cement is safe from both crack-resistant and yielding.

Figure 6:
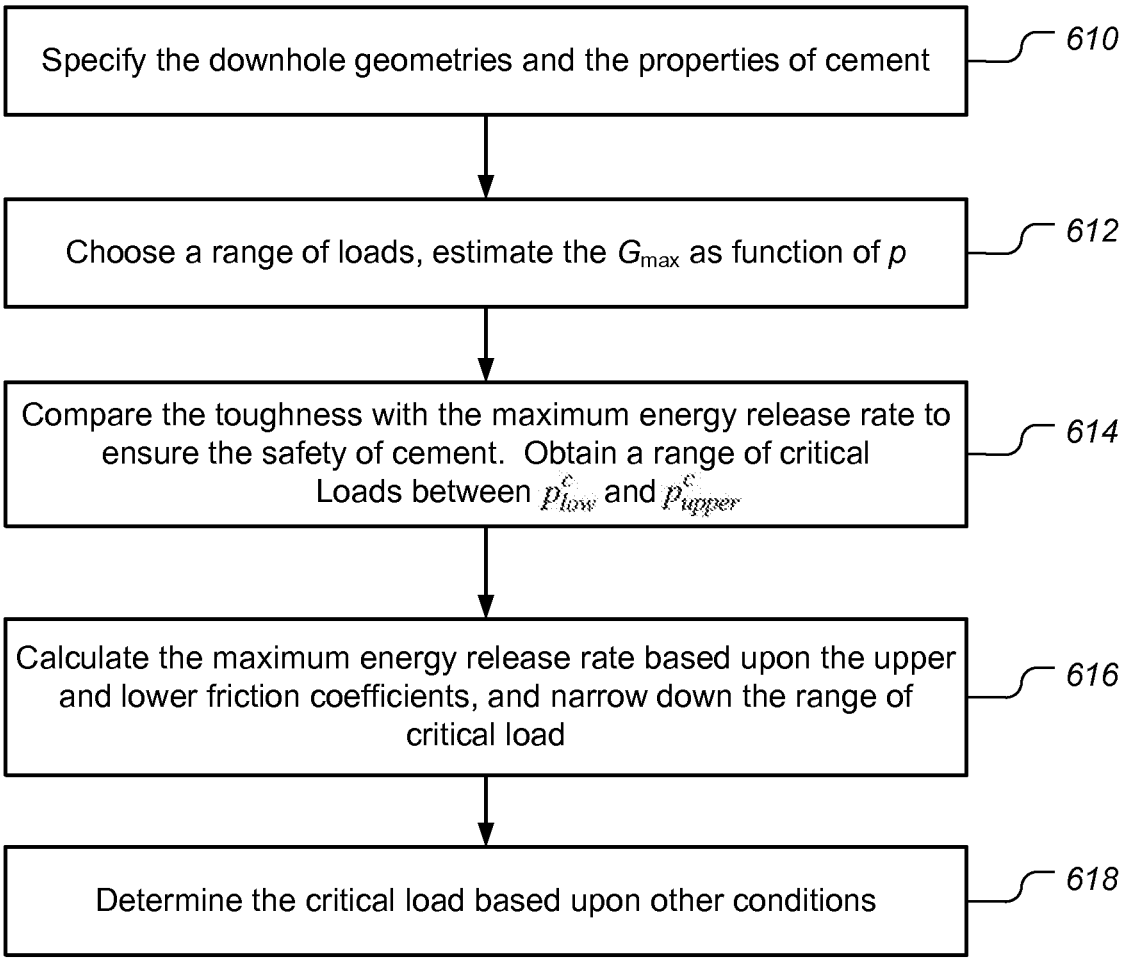
FIG. 6 is a flow chart illustrating a procedure for determining critical loading conditions based upon the specified cement properties and wellbore conditions, according to some embodiments.
Figure 7:
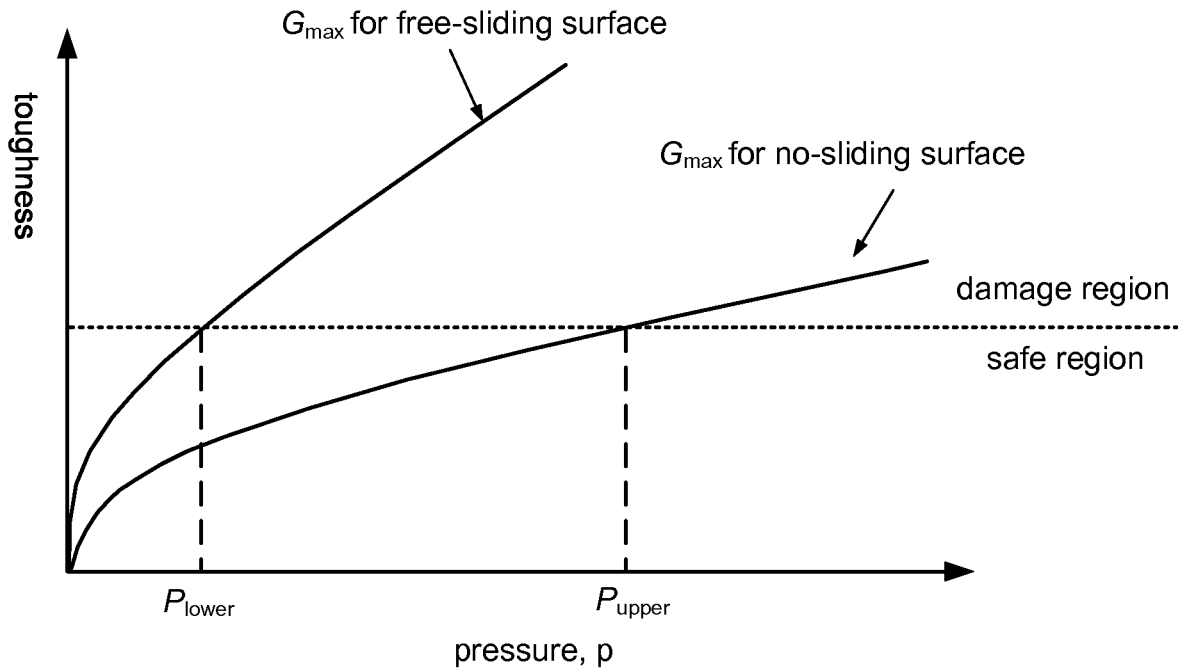
FIG. 7 is a graph schematically plotting maximum energy release rates for the "no-sliding" and "free-sliding" cases for the cement interfaces as function of pressure, according to some embodiments.

FIG. 6 is a flow chart illustrating a procedure for determining critical loading conditions based upon the specified cement properties and wellbore conditions, according to some embodiments. In block 610, the downhole geometries and the properties of cement are specified. The Young's modulus and Poisson's ratios for cement should be known from the completion records of the well. The toughness of cement can be estimated using simple correlation functions. See, e.g. James and Ulm, 2011. Alternatively, the cement toughness can be directly measured from a cement sample. In block 612, we choose a range of load, estimating the $G_{max}$ as function of pressure p. The method is discussed in further detail, infra. Here we need to consider the upper and lower bounds, which are the "no-sliding" and "free-sliding" cases for the cement/casing interface and the cement/formation interface. FIG. 7 is a graph schematically plotting maximum energy release rates for the "no-sliding" and "free-sliding" cases for the cement interfaces as function of pressure, according to some embodiments. These two upper and lower bounds are schematically plotted in FIG. 7.

Referring again to FIG. 6, in block 614 the toughness is compared with the maximum energy release rate to ensure the safety of the cement. A range of critical loads, $p_{low}^{c}$ and $p_{upper}^{c}$, are obtained. If we can estimate the range of friction coefficients, we can re-define the interface conditions. In block 616, the maximum energy release rate is calculated based upon the upper and lower friction coefficients. Based upon this range, we can narrow down the range of critical load. In block 618, the critical load is determined based upon other conditions such as the yielding conditions obtained from strength analysis. The lowest critical load should be chosen to ensure prevention of longitudinal crack propagation.

Figure 8:
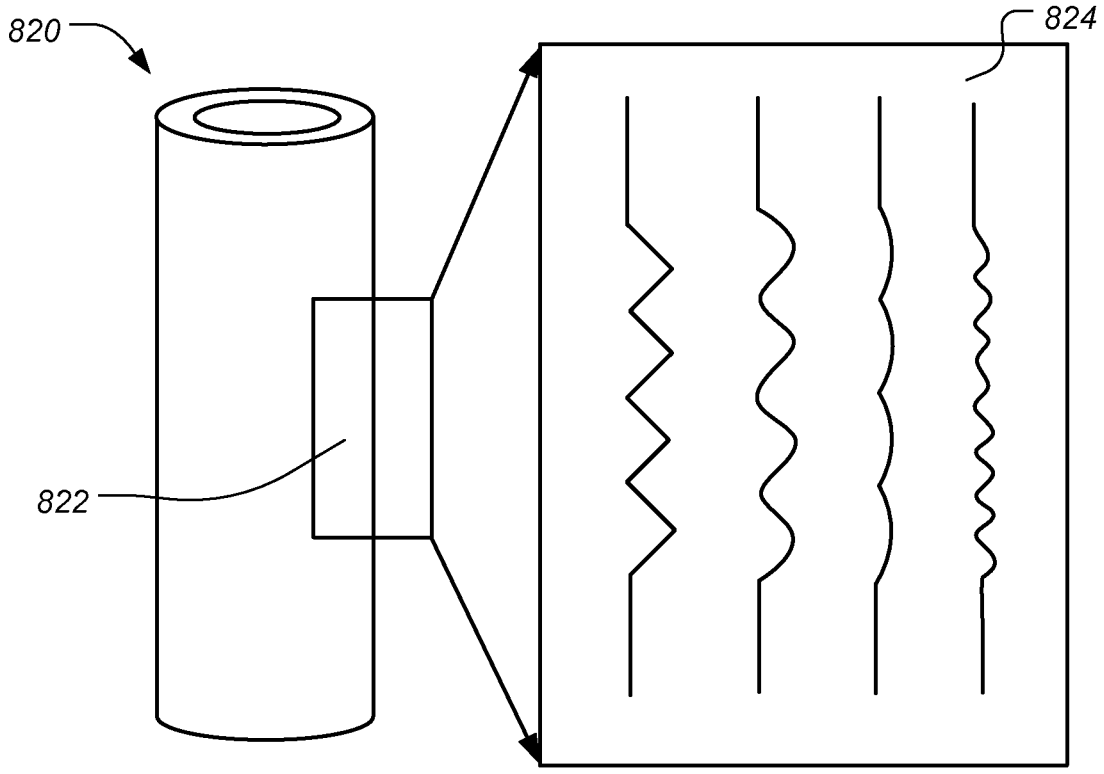
FIG. 8 is a diagram schematically illustrating patterned structures on a casing surface for increasing friction coefficient associated with the cement-casing interface, according to some embodiments.
Figure 9:
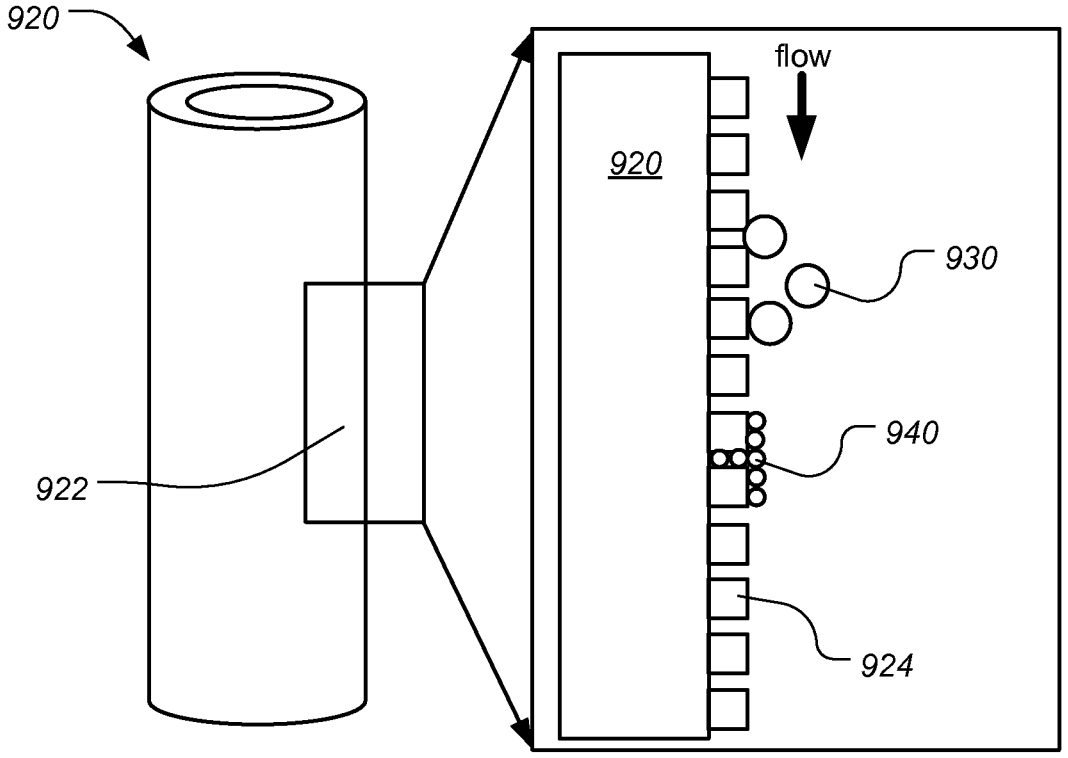
FIG. 9 is a diagram illustrating how to change the wettability of the outer surface of the casing, according to some embodiments.

It has been found that increasing friction forces on the cement/casing interfaces can significantly improve the crack-resistance of cement. Methods to improve the friction coefficient are described according to some embodiments. FIG. 8 is a diagram schematically illustrating patterned structures on a casing surface for increasing friction coefficient associated with the cement-casing interface, according to some embodiments. On the outer surface 822 of casing 820 patterns are made, such as the four example surface patterns shown in box 824. Further details on how to generate patterned structure are discussed infra. According to some other embodiments, the residue of drilling fluid is reduced or minimized on the casing/well surface by changing the wetting between the casing and the oil-based drilling fluid. FIG. 9 is a diagram illustrating how to change the wettability of the outer surface of the casing, according to some embodiments. On the outer surface 922 of casing 920 a morphology 924 is provided that repels oil residue 930 while leaving the wetting between water 940 and casing 920 unaffected. As a result, water based cement paste can still have good adhesion on the casing 920 despite the presence of some oil residue. Further details of providing such surface morphologies are described infra.

Further detail of modeling techniques will now be provided. Consider a simple wellbore geometry shown in FIG. 2. Cement 230 is placed between the casing 220 and formation 200. A crack may pre-exist in the cement sheath 230, which may be due to the shrinkage of cement during the hydration or due to the damage caused by perforation. The crack can grow radially along the R direction, which can cause local damage. This is because the cement sheath 230 is typically thousands of feet long. Alternatively, the crack can grow along the axial direction (i.e. parallel to the main longitudinal axis of the well). This type of crack growth—longitudinal propagation—however, can generate a channel that leads to loss of integrity of the entire (or large part of) cement sheath 230.

The driving force for longitudinal crack growth (i.e. along the axial direction) is the energy release rate, defined as $G_t$, in the longitudinal direction. If the energy release rate $G_t$ is greater than the toughness of cement, defined as $\Gamma_c$, then a crack will grow. Otherwise, a crack will remain stable. Therefore, the critical condition will be $$G_t=\Gamma_c \tag{1}$$

Energy release rate $G_t$ for a specified load and wellbore geometries can be obtained through many well-established methods. For example, see Ho, S. and Z. Suo, Microcracks tunneling in brittle matrix composites driven by thermal expansion mismatch, Acta Metallurgica et Materialia 40(7): 1685-1690 (1992). In general, $G_t$ depends on the size of the initial crack. However, it is impractical to determine the size and locations of all cracks inside cement sheath 230. Therefore, we use a maximum energy release rate $G_t$, defined as $G_t^{max}$, for crack size h reaching a critical value to compare with the toughness of the cement $\Gamma_c$. The crack will remain stable if $\Gamma_c>G_t^{max}$ and propagate if $\Gamma_c\leq G_t^{max}$.

According to some embodiments, we consider a wellbore 210 having a casing 220 with inner diameter (ID) of 8 inches, a cement sheath 230 is 1 inch thick and the casing 220 is ¼ inch thick. The stiffness of casing 220, cement 230 and formation 200 are given by as $E_s$=200 GPa and $v_s$=0.23, $E_c$=5 GPa and $v_c$=0.23, and $E_f$=12 GPa and $v_f$=0.23, where E refers to the Young's modulus, V refers to the Poisson's ratio and subscripts s, c and f refer to steel casing, cement and formation, respectively. The maximum energy release rate is calculated numerically using a finite element method. The energy release rate for the pressure up to 1000 psi is 15 J/m$^2$. Therefore, if the toughness of cement is larger than 15 J/m$^2$, the cement is safe; otherwise, propagation of tunneling (longitudinal) crack is anticipated along the cement sheath. For comparison, we have calculated the energy release rate in cases when the friction between casing/cement is zero. Under otherwise identical conditions, the energy release rate increases to 300 J/m$^2$, which is about an increase of 20 times. If the cement toughness remains 15 J/m$^2$, the maximum load that can be applied with the casing 220 decreases from 1000 psi to 220 psi. This indicates the importance of friction force between the casing and the cement.

Further detail of methods to increase the friction between cement and casing will now be provided, according to some embodiments. The longitudinal propagation of a tunneling crack involves the opening of a crack driven by the release of elastic energy. Friction forces in the cement/casing interface and the cement/formation interface resist the crack from opening. Using the model described supra, we found that the energy release rates increase up to two orders of magnitude by changing the interfacial condition from no-slipping to no-friction boundary conditions. Equivalently, the critical load it takes to cause longitudinal propagation of a tunneling crack will drop up to ten times when friction at the interfaces are lost. In addition, we found that the friction in the cement/casing interface is an important force to prevent the crack from opening. In general, this friction force is large enough when the drilling mud is fully cleaned. However, the friction can drop significantly if even a very thin layer of mud is left.

According to some embodiments, the friction between cement and casing is increased by improving the adhesion between cement and casing. According to one alternative, patterned structures are formed on the casing surface examples of which are shown in FIG. 8. Such structures will help improve the adhesion between the cement and casing. The patterned surface structures increase the roughness of the casing, thereby increasing the friction and adhesion between cement and casing. The size and shape of these patterned structures can be designed to meet different friction/adhesion requirements. According to some embodiments, adhesion between particles (e. g. cement) and substrate (e. g. casing) can be enhanced such as shown in Figure. 8 of M. Qu and A. Gouldstone, On the Role of Bubbles in Metallic Splat Nanopores and Adhesion, JTTEE5 17:486-494, DOI: 10.100/s11666-008-9198-9 (December 2008), hereinafter "Qu and Gouldstone (2008)". In this example, particles are melted and then solidified on substrate surface. Three surfaces were tested including a smooth surface, and two with different surface patterns. Adhesion tests were conducted on the samples using carbon tapes. It has been found that the adhesion between particles and casing can be significantly improved on the surface with patterned scratches. These results are adapted from the work described in Qu and Gouldstone (2008) studying the adhesion between thermal sprayed coating and substrate. According to some embodiments, similar techniques can be applied to current application of improving cement/casing bonding.

As mentioned, supra, when there is a thin layer of oil based drilling fluid residue on casing surface, the friction/adhesion between cement and casing can be dramatically reduced. According to some embodiments, the residue of drilling fluid on the casing/well surface can be minimized and/or reduced by changing the wetting between the casing and the oil-based drilling fluid. This can be done, for example, by changing the surface morphology of the casing. The surface morphology can be altered by changing the casing surface chemistry such that it repels oil (i.e. oleophobic). The surface chemistry can also be made hydrophilic, so that the bonding between cement paste and casing wall is not detrimentally affected. According to some embodiments, the surface chemistry of the casing is made both oleophobic and hydrophilic. Examples of the coating materials include, but are not limited to surfactants, fluorinated surfactants, and surfactant-polymer copolymers. An example of changing the surface morphology to reduce oil residue on the surface is shown schematically in FIG. 9.

Some of the methods and processes described above can be performed by a processor. The term "processor" should not be construed to limit the embodiments disclosed herein to any particular device type or system. The processor may include a computer system. The computer system may also include a computer processor (e.g., a microprocessor, microcontroller, digital signal processor, or general purpose computer) for executing any of the methods and processes described above.

The computer system may further include a memory such as a semiconductor memory device (e.g., a RAM, ROM, PROM, EEPROM, or Flash-Programmable RAM), a magnetic memory device (e.g., a diskette or fixed disk), an optical memory device (e.g., a CD-ROM), a PC card (e.g., PCMCIA card), or other memory device.

Some of the methods and processes described above, as listed above, can be implemented as computer program logic for use with the computer processor. The computer program logic may be embodied in various forms, including a source code form or a computer executable form. Source code may include a series of computer program instructions in a variety of programming languages (e.g., an object code, an assembly language, or a high-level language such as C, C++, or JAVA). Such computer instructions can be stored in a non-transitory computer readable medium (e.g., memory) and executed by the computer processor. The computer instructions may be distributed in any form as a removable storage medium with accompanying printed or electronic documentation (e.g., shrink wrapped software), preloaded with a computer system (e.g., on system ROM or fixed disk), or distributed from a server or electronic bulletin board over a communication system (e.g., the Internet or World Wide Web).

Alternatively or additionally, the processor may include discrete electronic components coupled to a printed circuit board, integrated circuitry (e.g., Application Specific Integrated Circuits (ASIC)), and/or programmable logic devices (e.g., a Field Programmable Gate Arrays (FPGA)). Any of the methods and processes described above can be implemented using such logic devices.

Although only a few examples have been described in detail above, those skilled in the art will readily appreciate that many modifications are possible in the examples without materially departing from this subject disclosure. Accordingly, all such modifications are intended to be included within the scope of this disclosure as defined in the following claims. In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke 35 U.S.C. § 112, paragraph 6 for any limitations of any of the claims herein, except for those in which the claim expressly uses the words 'means for' together with an associated function.

What is claimed is:

1. A method of cementing an annular volume within a wellbore, the volume partially defined by an outer surface of a casing, the method comprising:

determining one or more properties for performing the cementing resulting in a cement within the annular volume that is resistant to crack propagation in directions parallel to a main longitudinal axis of the wellbore, wherein the determining is based in part on an amount of friction between the outer surface of the casing and the cement; and cementing the annular volume according to the one or more determined properties.

2. A method according to claim 1 wherein the one or more properties includes Young's modulus of the cement.

3. A method according to claim 1 wherein the annular volume is further partially defined by an inner surface of a rock formation.

4. A method according to claim 1 wherein the determining is further based in part on a calculation of one or more values for an energy release rate of the cement.

5. A method according to claim 4 wherein one of the energy release rate values is calculated assuming no sliding between the cement and the casing.

6. A method according to claim 5 wherein one of the energy release rate values is calculated assuming no friction between the cement and the casing.

7. A method according to claim 6 wherein the one or more properties includes a value of Young's modulus of the cement between the energy release rate value calculated assuming no sliding and the energy release rate value calculated assuming no friction.

8. A method of inhibiting longitudinal propagation of cracks in cement in an annular volume within a wellbore, the volume partially defined by an outer surface of a casing, the method comprising:

determining one or more critical pressure load values for use as an upper fluid pressure limit within the casing that avoids longitudinal propagation of cracks in the cement, the determining being based in part on an amount of friction between the outer surface of the casing and the cement; and carrying out a pressure-increasing procedure in the wellbore while ensuring fluid pressure within the casing remains below at least one of the critical pressure load values.

9. A method according to claim 8 wherein the determining one or more critical pressure load values includes comparing cement toughness with one or more values for energy release rate for the cement.

10. A method according to claim 9 wherein one of the energy release rate values is calculated assuming no sliding between the cement and the casing.

11. A method according to claim 10 wherein one of the energy release rate values is calculated assuming no friction between the cement and the casing.

12. A method according to claim 11 wherein the determining one or more critical pressure load values includes cement yielding conditions obtained from strength analysis.

* * * * *